United States Patent [19]

Reid

[11] 4,124,489

[45] Nov. 7, 1978

[54] PRODUCTION OF TRANSFORMER OIL FEED STOCKS FROM WAXY CRUDES

[75] Inventor: Lloyd E. Reid, Sarnia, Canada

[73] Assignee: Exxon Research & Engineering Co., Linden, N.J.

[21] Appl. No.: 768,961

[22] Filed: Feb. 16, 1977

[51] Int. Cl.[2] ..... C10G 41/00

[52] U.S. Cl. ..... 208/87; 208/14

[58] Field of Search ..... 208/14, 87

[56] References Cited

U.S. PATENT DOCUMENTS

| | | | |
|---|---|---|---|
| 3,627,673 | 12/1971 | Sproule et al. | 208/14 |
| 3,732,154 | 5/1973 | Mills et al. | 208/87 |
| 3,932,267 | 1/1976 | Lewis et al. | 208/87 |
| 4,008,148 | 2/1977 | Masunaga et al. | 208/211 |

*Primary Examiner*—Herbert Levine

*Attorney, Agent, or Firm*—Edward M. Corcoran

[57] ABSTRACT

Transformer oil feedstocks are produced by double solvent extracting a raw, untreated, light distillate fraction from a waxy crude oil to produce a second, wax-containing extract. The second extract oil is hydrotreated to mildly crack same, reduce the sulfur content and improve the viscosity oxidation and color stability thereof. This hydrotreated oil is then distilled to produce a transformer oil feedstock of relatively low wax content as a heart cut fraction having a 5 to 95 LV% boiling range between about 595° to 750° F. The transformer oil feedstock may then be dewaxed using any well known method such as solvent or catalytic dewaxing to obtain a low pour point transformer oil.

20 Claims, 1 Drawing Figure

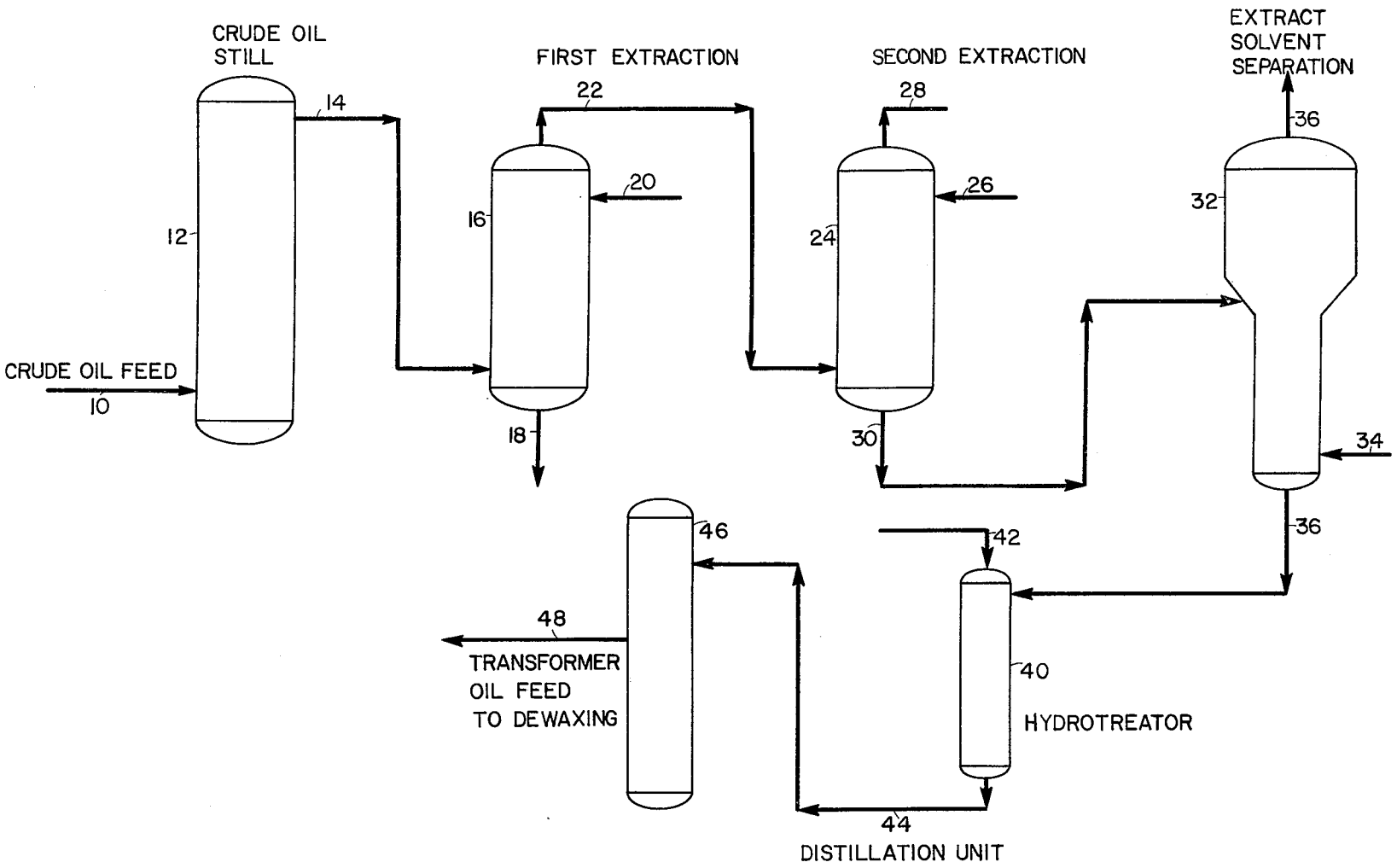
CRUDE OIL FEED
10
CRUDE OIL STILL
12
14
FIRST EXTRACTION
16
18
20
22
SECOND EXTRACTION
24
26
28
30
EXTRACT SOLVENT SEPARATION
32
34
36
36
HYDROTREATOR
40
42
DISTILLATION UNIT
44
46
TRANSFORMER OIL FEED TO DEWAXING
48

PRODUCTION OF TRANSFORMER OIL FEED STOCKS FROM WAXY CRUDES

BACKGROUND OF THE INVENTION

1. Field of the Invention

This invention relates to a process for producing transformer oil feedstocks. More particularly, this invention relates to a double solvent extraction-hydrotreating process for producing transformer oil feedstocks from raw, untreated light distillate fractions obtained from paraffinic crude oils. The transformer oil feedstock may then be dewaxed to produce a low pour point transformer oil.

2. Description of the Prior Art

Transformer oils are high stability electrical insulating oils used in transformers and in other electrical equipment such as circuit breakers. In transformers the oil provides two major functions. The first is as an insulator and the second is as a heat transfer medium to carry heat from the coils to the cooling surfaces of the transformer. These oils must be low in corrosive agents such as acid, alkali and sulfur and resistant to oxidation and sludge formation. In addition to possessing relatively low viscosity, high electric strength and a relatively high flash point, these oils are further characterized in that they must have a relatively low pour point. This is particularly necessary when the oils are used in transformers in colder climates.

These transformer oil stocks are generally produced from relatively wax-free naphthenic crude oils which are not native to many parts of the world and consequently command premium prices and involve high transportation costs. Further, the production of naphthenic crude oils is rapidly diminishing due to government takeover of heretofore privately owned wells and drying up of others. At the same time, demand for these oils continues to increase as industry and modern civilization continue its growth. Therefore, there is an ever increasing need to produce these oils from paraffinic crudes. Extremely stable insulating oils produced either totally or partially from paraffinic crudes by conventional dewaxing techniques are used in certain applications where moderate climatic conditions do not demand oil with especially low cloud or pour points. However, when exceptionally low pour points are required, deep dewaxing of paraffinic distillates at temperatures below −40° F. cannot compete economically with the manufacture of these oils from naphthenic crudes.

Fortunately, however, low pour point transformer oils can be obtained from paraffinic crudes by using, as a transformer oil feed, a narrow cut paraffinic fraction having a 5 to 95LV% (liquid volume) boiling range between about 595° to 750° F. Certain well fractionated, narrow cut, low viscosity distillates taken as a heart cut distillate exhibit a pour-filter inversion when ketone dewaxed, in which the pour point of the dewaxed oil can be as low as 30° to 40° F. below the wax filtration temperature. In contrast, conventional (broad cut) distillates when ketone dewaxed generally exhibit a pour point about 5° F. above the wax filtration temperature. This is disclosed in U.S. Pat. Nos. 2,906,688, 3,627,673 and in pending application, U.S. Ser. No. 599,690 (filed July 28, 1975) now U.S. Pat. No. 4,018,666. For the purposes of the instant invention these distillates shall be referred to as transformer oil feedstocks and have a viscosity ranging from about 40 to 70 SUS at 100° F. with a 5 to 95LV% boiling range between about 595° to 750° F.

SUMMARY OF THE INVENTION

Accordingly, therefore, a process has now been found for producing a transformer oil feedstock from a paraffinic oil which comprises:

(a) solvent extracting a light, untreated distillate fraction from a paraffinic crude oil to produce a first raffinate and a first extract;

(b) solvent extracting said first raffinate to produce a second raffinate and a second extract and separating solvent from second extract to obtain a waxy oil therefrom;

(c) contacting said waxy oil with hydrogen at hydrotreating conditions in the presence of a hydrotreating catalyst to form a hydrotreated oil; and (d) distilling said hydrotreated oil to obtain a transformer oil fraction therefrom as a heart cut fraction. An additional benefit realized by the practice of this invention is that the transformer oil or feedstock so produced contains very little wax thereby readily lending itself to a catalytic dewaxing process for wax removal.

The light distillate is taken directly from a crude vacuum pipestill containing any paraffinic crude oil. This light distillate should have a viscosity ranging between about 75 to 230 SUS at 100° F. and boiling within the range of from about 590° to 910° F. The light distillate is solvent extracted to yield a first raffinate containing about 75 to 85LV% of the distillate and first extract containing most of the treat solvent plus the worst of the multi-ring aromatics from the feed, using any conventional extraction solvent such as phenol, N-methyl-2-pyrrolidone (NMP), furfural, etc. The degree of extraction will depend of course on the nature of the oil.

Raffinate from the fist extraction zone containing about 10 to 15 LV% extraction solvent is fed directly to the second extraction zone. If desired, extraction solvent may be removed from the first raffinate before it is passed to the second extraction zone. Solvent used for the second extraction is preferably of the same composition as that used for the first extraction. The treat rate of extraction solvent to the first raffinate in the second extraction zone will range from about 90 to 170 LV%, based on the oil content of the first raffinate at a temperature ranging from about 118° to 160° F., to form a second raffinate and a second extract. Extract from the second zone, containing most of the treat solvent and the balance of the aromatic and the naphthenic compound in the feed, is sent to solvent recovery. The yield of extract oil from the second extraction zone can range from 10 to 21 LV% of the oil fed to the second zone. The second raffinate containing about 10 to 15 LV% solvent is also sent to solvent recovery.

Extraction solvent is removed from the second extract with the solvent-free oil resulting therefrom being passed directly to a hydrotreating zone. The hydrotreating reduces the viscosity and sulfur content of the oil as well as improving the color, color stability and molecular distribution (paraffinic, naphthenic and aromatic hydrocarbons) for optimum transformer oil quality. At the same time, the amount of material in the transformer oil boiling range (595° to 750° F.) is substantially increased. The hydrotreating may be accomplished in one or more zones at one or more hydrotreating temperatures, i.e., a single hydrotreating stage or zone at a single temperature or two or more stages or zones of hydrotreating operating at two or more temperatures. In the hydrotreating zone, the solvent-free second extract and hydrogen are contacted with a conventional hydrotreating catalyst. Typical examples would be catalytic metals such as nickel, cobalt, tungsten, iron, molybdenum, mangenese, platinum, palladium and combinations of these supported on well known conventional supports such as silica, alumina, magnesia and combinations of these with or without acid-acting substances such as halogens and phosphorus. Particularly preferred catalysts include oxides or sulfides of such combinations of metals as cobalt-/molybdenum and nickel/molybdenum supported on alumina or on alumina/silica. In general, the hydrotreating will be accomplished by passing the extract over a fixed bed at a liquid hourly space velocity (LHSV) ranging between about 0.25 to 1.5 V/V/h (volumes/volume/hour), more preferably from 0.25 to 1.0 V/V/h, at a temperature ranging between about 600° F. and former oil fraction or feed stock as a heart cut from the hydrotreated oil. By heart cut is meant that it is taken as a fraction having a finite boiling range and not as either a top or bottom cut.

The transformer oil fraction or feed so obtained will have a 5 to 95 LV% boiling range of between about 595° to 750° F. at a pressure of one atmosphere. More preferred are fractions exhibiting a boiling range of from about 600° to 745° F. and most preferably 600° to 735° F. at one atmosphere. These oils will have a viscosity ranging from about 40 to 70 SUS at 100° F. and more preferably from 50 to 60 SUS. Of course, the exact quality of the cut will depend on the particular rectification and/or distillation unit employed and the number of plates therein. Also, the narrower the cut or fraction the greater will be the pour-filter inversion when ketone dewaxed at a given or fixed filtration temperature. Concomitant with this of course is the fact that the yield of transformer oil feeds so obtained will depend on the narrowness of the boiling range of the fraction. In general, however, at least about 25 LV% of a low wax content transformer oil feed stock having a viscosity ranging from about 50 to 60 SUS at 100° F. and a 5 to 95 LV% boiling range of from 595° to 750° F. will be obtained from the process of this invention.

The transformer oil feed so obtained may be solvent dewaxed using ketone dewaxing solvent or a mixture of one or more ketones with aromatic and/or autorefrigerant hydrocarbons such as toluene, propane or propylene at a temperature ranging from about −10° F. to −30° F. to produce a solvent-free dewaxed oil having a pour point ranging from about −30° F. to −60° F. and a viscosity of from 50 to 60 SUS at 100° F. The dewaxing may be accomplished under miscible or immiscible conditions. In copending patent application U.S. Serial No. 599,690, it is disclosed that a low pour point transformer oil may be produced by immiscible solvent dewaxing a narrow cut distillate of a paraffinic crude whereby two liquid and one solid phases form a wax-containing slurry which is then filtered to produce a wax cake which contains a high viscosity index oil on the wax cake and a filtrate which contains a very low pour point transformer oil. The disclosures of this application are incorporated herein by reference. Alternatively, because of the fact that the transformer oil fractions produced by the operation of this invention generally have such a relatively low wax content (i.e., about 2 to 5 wt.%) the wax-containing transformer oil feed may be catalytically dewaxed to produce a very low pour point finished transformer oil. Catalytic dewaxing or hydrodewaxing wherein paraffinic wax type hydrocarbons are removed from oil fractions such as lube oil fractions are well known in the art. For instance, U.S. Pat. Nos. 3,516,925 and 3,539,438 disclose catalytically dewaxing heavier hydrocarbon oils such as lube oil fractions over a decationized mordenite-type crystalline aluminosilicate preferably containing a hydrogenation component selected from Group VI and VIII metals and oxides thereof and more particularly noble metal hydrogenating components such as platinum or palladium. In catalytic dewaxing processes, waxy hydrocarbons, particularly the normal paraffinic types, are selectively hydrocracked into lower boiling hydrocarbons which are primarily gases at room temperature, thereby producing a dewaxed oil having a substantially lower wax content and concomitantly lower pour point but whose boiling range is the same as the boiling range of the feed. Similarly, U.S. Pat. No. 3,700,585 discloses the use of crystalline aluminosilicates of the ZSM-5 and ZSM-8 types for catalytically dewaxing both normal and slightly branched paraffins from hydrocarbon fractions such as jet fuel and lube oil fractions. The disclosures of these patents are incorporated herein by reference.

BRIEF DESCRIPTION OF THE DRAWING

The attached drawing is a flow diagram of a process for producing transformer oil feed stocks in accordance with a preferred embodiment of this invention.

DETAILED DESCRIPTION

Referring to the drawing, a wax-containing paraffinic crude, such as an Aramco crude, is fed into a conventional refinery crude still 12 via line 10, wherein the crude oil is fractionated into several cuts, including a cut having a 5 to 95% LV boiling range of 590° to 910° F. measured at atmospheric pressure, an API gravity of from 22° to 30° and a viscosity ranging from about 75 to 230 SUS at 100° F. This cut is taken from crude still 12 via line 14 and passed to extraction zone 16 wherein it is mildly extracted with an extraction solvent such as NMP containing minor amounts of water which enters the extraction zone countercurrently via line 20. In extraction zone 16, the oil is mildly extracted at a temperature ranging from about 110° to 180° F. and at a treat rate of solvent to oil feed ranging from about 70 to 90 LV% so that most of the multi-ring aromatic and polar constituents of the oil are removed therefrom as a first extract via line 18, said first extract also containing substantially most of the extraction solvent. The first raffinate along with minor amounts of extraction solvent (i.e., 10 to 15 LV%) is removed from extraction zone 16 via line 22 and passed directly to a second extraction zone 24 wherein it is contacted with fresh extraction solvent. Extraction zone 24 also operates at a temperature ranging from about 110° to 180° F. but with a treat ratio of solvent to first raffinate oil from about 85 to 165 LV%. In second extraction zone 24 the extracted solvent also passes countercurrently to the first raffinate thereby extracting same and forming a second raffinate and a second extract, with the second extract oil containing the balance of the aromatic and naphthenic components in the feed. The second raffinate is removed from zone 24 via line 28 and sent to further processing, while the second extract is removed via line 30 and passed to separation zone 32 wherein the extraction solvent is removed from the second extract oil. Separation zone 32 may be a distillation, rectification, steam or gas stripping zone, or combination thereof. Preferably zone 32 will be a combination of flash evaporation, rectification and stripping zones with the extract initially being fed directly into the flash zone via line 30. Solvent overheads are removed from solvent separation zone 32 via line 36 with substantially solvent-free second extract oil being removed therefrom as bottoms via line 36 which are then passed directly to hydrotreating zone 40. Hydrogen enters hydrotreating zone 40 via line 42 and mixes with the solvent-free extract oil which are then passed over a fixed bed of a catalyst comprising nickel/molybdenum on alumina (containing 1 to 2 wt.% silica). Zone 40 operates at a temperature ranging from about 600° to 725° F., a hydrogen partial pressure of 500 to 1500 psig and a liquid hourly space velocity of from about 0.25 to 1.0 V/V/hr. Hydrotreated oil is removed from zone 40 via line 44 and passed to distillation unit 46 wherein the hydrotreated oil is fractionated to form several fractions, including a transformer oil feed stock or fraction which is removed therefrom as a heart cut via line 48 and sent to a dewaxing process (not shown). As hereinbefore stated under SUMMARY OF THE INVENTION, supra, the dewaxing process employed can be a solvent dewaxing or a hydrocatalytic dewaxing process to produce a finished transformer oil having a pour point of at least about −30°, more preferably −40° and most preferably −50° F.

PREFERRED EMBODIMENT

This invention will be more apparent from a preferred embodiment which is illustrated by the examples set forth below.

EXAMPLE 1

This example shows how the second extraction of a double extraction process produces an extract which is of a better quality (higher gravity, lower sulfur and CCR, etc.) than the extract produced by a typical single extraction to about the same VI raffinate oil. The light, untreated distillate was obtained from a light Arabian crude oil and had a 5 to 95 LV% boiling range of 651° to 892° F. at one atmosphere, a gravity of 22.6° API, a viscosity of 228 SUS at 100° F. and 46.6 SUS at 210° F. The single extraction was carried out to obtain a raffinate oil which was dewaxed to a pour point of 15° F. and a VI of 108. The yield on the extraction was 59 LV% raffinate oil and 41 LV% extract oil. In the double extraction, the extractions were carried out to yield a combined first and second raffinate oil which when dewaxed to a pour point of 15° F. had a VI of 107. Thus, both processes were conducted to yield a total raffinate oil of substantially identical VI levels at a given pour point. In the double extraction, the yield of the first raffinate and extract oils were 76 LV% and 24 LV%, respectively. In the second extraction the second raffinate and extract yields were 79 and 21 LV% of the first raffinate, respectively. Thus, the overall raffinate and extract yields were 60 and 40 LV%, respectively. The extraction solvent used was NMP containing a minor amount of water.

The results are listed in Table 1.

TABLE 1

PROPERTIES OF ARAB LIGHT EXTRACTS

| Process<br>Extract from<br>Extract (Waxy) Inspections | Single Extraction<br>Single Extraction | Double Extraction<br>Second Extraction |
|---|---|---|
| Refractive Index at 60° C | 1.5397 | 1.5185 |
| Gravity, °API | 11.9 | 16.5 |
| Viscosity, SUS, 210° F | 55.6 | 52.3 |
| Sulfur, wt.% | 4.1 | 3.5 |
| CCR, wt.% | 0.25 | 0.15 |
| Pour Point, ° F | +70 | +44 |

EXAMPLE 2

This example illustrates the effect of hydrotreating the waxy, second extract of the light Arab distillate from Example 1. The solvent-free extract oil resulting from the second extraction was fed into a hydrotreating zone over a nickel/molybdate on alumina catalyst commercially available as Cyanamid Aero HDS-9A. The composition of this catalyst was 14.0 wt.% $MoO_3$, 2.8 wt.% NiO, 1.5 wt.% $SiO_2$, and about 82 wt.% alumina.

The results of hydrotreating at two different temperatures are shown in Table II. GC distillations of feed and hydrotreated products show the amount of material boiling within the desired range of 595° to 750° F. and having a viscosity of from 50 to 60 SUS at 100° F. It will be seen that approximately 25% of transformer oil feed product was obtained at 650° F. while over 30% was obtained at 675° F. In both cases the wax content was found to be less than 5% of the transformer oil feed so produced. Further, it can be seen that in both cases the transformer oil feed product would be obtained as a heart cut.

TABLE II

HYDROTREATING ARAB LIGHT SECOND EXTRACT

| Run No. 17-275-43- | Hydrotreater Feedstock(1) | 8 | 10 |
|---|---|---|---|
| Hydrotreater Conditions(2) | | | |
| Temperature, ° F | — | 650 | 675 |
| Pressure, psig $H_2$ | — | 1000 | 1000 |
| LHSV, v/v/h | — | 0.5 | 0.5 |
| Excess Gas Rate, SCF $H_2$/B | — | 1000 | 1000 |
| Product(3) Recovery on Feed, wt.% | 100.0 | 97 | 97 |
| Product(3) Inspections | | | |
| Gravity, °API | 16.5 | 23.2 | 25.3 |
| Viscosity, SUS, 100° F | 444 | 185 | 121 |
| Viscosity, SUS, 210° F | 52.3 | — | — |
| Viscosity Index | 28 | — | — |
| Refractive Index at 60° C | 1.5185 | 1.4942 | 1.4870 |
| Cloud/Pour Points, ° F | 62/44 | 63/26 | 62/26 |
| Color, ASTM | D8.0 | L2.0 | L2.0 |
| CCR, Wt.% | 0.15 | <0.05 | <0.05 |
| Sulfur, Wt.% | 3.5 | 0.7 | 0.2 |
| Nitrogen, wppm | 990 | — | 50 |
| Carbon Analysis, %(4) | | | |
| Paraffinic | 36 | — | 53 |
| Naphthenic | 34 | — | 28 |
| 10 Aromatic | 30 | — | 29 |
| GG Distillation, LV% Overhead | Temperature ° F | | |
| IBP | 651 | 264 | 196 |
| 1 | 682 | 450 | 295 |
| 5 | 723 | 633 | 507 |
| 10 | 745 | 676 | 619 |
| 15 | 757 | 700 | 662 |
| 20 | 768 | 718 | 689 |
| 30 | 786 | 747 | 725 |
| 40 | 801 | 766 | 750 |
| 50 | 815 | 784 | 772 |
| 60 | 829 | 801 | 790 |
| 70 | 844 | 819 | 808 |
| 80 | 860 | 837 | 828 |
| 90 | 880 | 860 | 851 |
| 95 | 892 | 876 | 869 |
| 98 | 903 | 891 | 885 |

TABLE II-continued

| HYDROTREATING ARAB LIGHT SECOND EXTRACT | | | |
|---|---|---|---|
| FBP | 925 | 912 | 907 |

(1)Yield of extract (waxy) feedstock on Arab Light raw distillate = 15.8 LV%.
(2)Cyanamid Aero HDS-9A (nickel/molybdate) catalyst, treat gas = 100% $H_2$.
(3)Total liquid product (TLP).
(4)ASTM D-2140. Carbon analysis for run 17-275-43-10 carried out on stripped bottoms product from hydrotreater stripper (feed = TLP). Yield of stripper bottoms = 93.5 LV% on hydrotreater feed.

What is claimed is:

1. A process for producing a transformer oil feed stock from a paraffinic oil which comprises:
(a) mildly solvent extracting a light, untreated distillate fraction from a paraffinic crude oil at a temperature ranging from about 110° to 180° F. so that most of the multi-ring aromatic and polar constituents of the oil are removed therefrom as a first extract thereby producing a first raffinate and a first extract;
(b) solvent extracting said first raffinate at a temperature ranging from about 110° to 180° F. and at a treat rate of solvent to first raffinate oil of from about 85 to 165 LV% so that most of the aromatic and naphthenic components are removed from the first raffinate oil as a second extract and separating solvent from said second extract to obtain a waxy oil therefrom;
(c) contacting said waxy oil with hydrogen at hydrotreating conditions in the presence of a hydrotreating catalyst to form a hydrotreated oil; and
(d) distilling said hydrotreated oil to obtain a transformer oil fraction therefrom as a heart cut fraction having a 5 to 95 LV% boiling range between about 595° to 750° F.

2. The process of claim 1 wherein said light distillate oil has a viscosity ranging from 75 to 230 SUS at 100° F. and a 5 to 95 LV% boiling range within 590° to 910° F.

3. The process of claim 2 wherein said hydrotreating conditions include a liquid hourly space velocity of from 0.25 to 1.5 V/V/h and a hydrogen pressure of from 500 to 1500 psig.

4. The process of claim 3 wherein said first raffinate is produced in an amount of at least about 75 LV% of said light distillate.

5. The process of claim 4 wherein said extraction solvent is selected from the group consisting of NMP, phenol and furfural along with minor amounts of water.

6. The process of claim 4 wherein said second extract is produced in an amount ranging from about 10 to 21 LV% of the oil content of said first raffinate.

7. The process of claim 6 wherein said transformer oil fraction has a wax content of no more than about 5 wt.%.

8. The process of claim 7 wherein said transformer oil fraction has a viscosity ranging from about 40 to 70 SUS at 100° F.

9. A process for producing a low wax content transformer oil feed stock from a paraffinic crude oil which comprises:
(a) mildly solvent extracting a light, untreated distillate fraction obtained from said paraffinic crude oil at a temperature ranging from about 110° to 180° F. so that most of the multi-ring aromatic and polar constituents of the oil are removed therefrom as a first extract thereby producing a first raffinate and a first extract, said light distillate having a viscosity within the range of from about 75 to 230 SUS at 100° F., an API gravity within the range of about 22° to 30° and a 5 to 95 LV% boiling range within the range of about 590° to 910° F. at atmospheric pressure;
(b) solvent extracting said first raffinate at a temperature ranging from about 110° to 180° F. and at a treat rate of solvent to first raffinate oil of from about 85 to 165 LV% so that most of the aromatic and naphthenic components are removed from the first raffinate oil as a second extract and removing extraction solvent from said second extract to obtain a waxy oil therefrom;
(c) contacting said waxy oil with hydrogen and a hydrotreating catalyst at hydrotreating conditions to form a hydrotreated oil having a sulfur content and viscosity lower than that of said waxy oil; and
(d) distilling said hydrotreated oil to obtain a transformer oil feed stock therefrom as a heart cut fraction having a 5 to 95 LV% boiling range between 595° to 750° F. at atmospheric pressure and a viscosity within the range of 40 to 70 SUS at 100° F.

10. The process of claim 9 wherein said hydrotreating conditions include a hydrogen pressure within the range of from 500 to 1500 psig and a liquid hourly space velocity within the range of from 0.25 to 1.5 V/V/hr.

11. The process according to claim 10 wherein said hydrotreating conditions include a temperature within the range of from about 600° to 725° F.

12. The process of claim 10 wherein said first raffinate oil is produced in an amount of at least 75 LV% of said light distillate.

13. The process of claim 12 wherein said second extract is produced in an amount ranging from about 10 to 21 LV% of said first raffinate oil.

14. The process of claim 10 wherein said transformer oil feed stock has a viscosity within the range of 50 to 60 SUS at 100° F. and a 5 to 95 LV% boiling range within the range of from 600° to 735° F. at atmospheric pressure.

15. The process of claim 10 wherein said hydrotreated oil contains a greater amount of material boiling within the range of 595° to 750° F. than said waxy oil.

16. The process of claim 10 wherein said hydrotreating catalyst comprises one or more catalytic metals on an alumina/silica support.

17. The process of claim 16 wherein said catalytic metal is selected from the group consisting of nickel, cobalt, tungsten, iron, molybdenum, manganese, platinum, palladium and combinations thereof.

18. The process of claim 16 wherein the extraction solvent is NMP containing minor amounts of water.

19. The process of claim 16 wherein said transformer oil feed stock contains no more than about 5 wt.% wax.

20. The process of claim 19 wherein said transformer oil feed stock is dewaxed to produce a transformer oil.

* * * * *